US011026857B2

(12) United States Patent
Lim

(10) Patent No.: US 11,026,857 B2
(45) Date of Patent: Jun. 8, 2021

(54) SHOULDER HOLD-DOWN AND LOCKING MECHANISM THEREFOR FOR USE WITH A SURGICAL FRAME

(71) Applicant: WARSAW ORTHOPEDIC, INC., Warsaw, IN (US)

(72) Inventor: Roy K. Lim, Germantown, TN (US)

(73) Assignee: WARSAW ORTHOPEDIC, INC., Warsaw, IN (US)

( * ) Notice: Subject to any disclaimer, the term of this patent is extended or adjusted under 35 U.S.C. 154(b) by 227 days.

(21) Appl. No.: 16/395,821

(22) Filed: Apr. 26, 2019

(65) Prior Publication Data

US 2020/0337929 A1 Oct. 29, 2020

(51) Int. Cl.
*A61G 13/12* (2006.01)
*A61G 13/00* (2006.01)

(52) U.S. Cl.
CPC ..... *A61G 13/1295* (2013.01); *A61G 13/0072* (2016.11); *A61G 13/126* (2013.01); *A61G 13/1255* (2013.01); *A61G 2210/10* (2013.01)

(58) Field of Classification Search
CPC ..... A61G 13/0072; A61G 13/1255; A61G 13/126; A61G 2210/10; A61G 13/1295; A61G 13/101; A61G 13/1205; A61G 13/121; A61G 13/1215; A61G 13/122; A61G 13/1225; A61G 13/123; A61G 13/1235; A61G 13/124; A61G 13/1245; A61G 13/125; A61G 7/075; A61G 7/1084; A61G 7/1086; A61G 7/1088; A61G 7/109; A61G 7/1092; A61G 7/1094; A61G 7/1096; A61G 7/1098; F16B 7/048; F16B 7/0493; Y10T 403/7105; Y10T 403/7182; Y10T 403/7194; Y10T 403/595
See application file for complete search history.

(56) References Cited

U.S. PATENT DOCUMENTS

| | | | | |
|---|---|---|---|---|
| 2,691,979 | A | 10/1954 | Watson | |
| 4,029,089 | A | 6/1977 | Mulhlland | |
| 4,915,101 | A | 4/1990 | Cuccia | |
| 5,410,769 | A | 5/1995 | Waterman | |
| 6,032,309 | A | 3/2000 | Michelson | |
| 6,076,525 | A | 6/2000 | Hoffman | |
| 6,260,220 | B1 * | 7/2001 | Lamb | A61G 13/02 5/601 |
| 6,277,069 | B1 * | 8/2001 | Gray | A61B 17/6466 600/234 |
| 6,566,833 | B2 | 5/2003 | Barlett | |
| 6,715,169 | B2 | 4/2004 | Niederkrom | |
| 6,728,983 | B2 | 5/2004 | Bartlett et al. | |

(Continued)

OTHER PUBLICATIONS

International Search Report and Written Opinion dated Feb. 6, 2020 from corresponding International Application No. PCT/US2019/056915.

*Primary Examiner* — Nicholas F Polito
*Assistant Examiner* — George Sun

(57) ABSTRACT

A shoulder hold-down is provided for use in securing at least a shoulder of a patient in position relative to a surgical frame. The shoulder hold-down includes a locking mechanism that is adjustable to afford positioning of a shoulder engaging portion for contacting the patient. The locking mechanism facilitates at least four (4) modes of adjustment to position the shoulder engaging portion relative to the patient.

20 Claims, 7 Drawing Sheets

(56) References Cited

U.S. PATENT DOCUMENTS

| | | | | |
|---|---|---|---|---|
| 6,732,390 | B2 | 5/2004 | Krywiczanin | |
| 6,934,986 | B2 | 8/2005 | Krywiczanin et al. | |
| 6,941,951 | B2 | 9/2005 | Hubert et al. | |
| 7,219,379 | B2 | 5/2007 | Krywiczanin et al. | |
| 7,472,440 | B2 | 1/2009 | Bartlett et al. | |
| 8,286,283 | B2 * | 10/2012 | Copeland | A61G 13/12 5/621 |
| 9,072,646 | B2 | 7/2015 | Skripps et al. | |
| 9,522,078 | B2 | 12/2016 | Pizzini | |
| 9,554,959 | B2 * | 1/2017 | Carn | A61G 13/123 |
| 9,937,006 | B2 | 4/2018 | Skripps et al. | |
| 2002/0138905 | A1 | 10/2002 | Barltett et al. | |
| 2002/0138906 | A1 | 10/2002 | Barltett et al. | |
| 2003/0140419 | A1 | 7/2003 | Barltett et al. | |
| 2003/0140420 | A1 | 7/2003 | Niederkrom | |
| 2003/0145382 | A1 | 8/2003 | Krywiczanin | |
| 2004/0010849 | A1 | 1/2004 | Krywiczanin et al. | |
| 2004/0123388 | A1 | 7/2004 | Coppens et al. | |
| 2006/0037141 | A1 | 2/2006 | Krywiczanin et al. | |
| 2006/0162076 | A1 | 7/2006 | Bartlett et al. | |
| 2012/0103344 | A1 * | 5/2012 | Hunter, Jr. | A61G 13/1235 128/845 |
| 2012/0144589 | A1 * | 6/2012 | Skripps | A61G 13/122 5/624 |
| 2013/0312189 | A1 | 11/2013 | Sarma et al. | |
| 2015/0272681 | A1 | 10/2015 | Skripps et al. | |
| 2016/0151224 | A1 * | 6/2016 | Ferro | A61G 13/1245 128/845 |
| 2016/0193099 | A1 | 7/2016 | Drake | |
| 2017/0049651 | A1 | 2/2017 | Lim | |
| 2017/0049653 | A1 | 2/2017 | Lim | |
| 2017/0112698 | A1 * | 4/2017 | Hight | A61G 13/104 |
| 2018/0363596 | A1 * | 12/2018 | Lim | A61G 13/08 |
| 2019/0000702 | A1 | 1/2019 | Lim et al. | |
| 2019/0000707 | A1 | 1/2019 | Lim et al. | |
| 2019/0046381 | A1 | 2/2019 | Lim et al. | |
| 2019/0046383 | A1 | 2/2019 | Lim et al. | |

* cited by examiner

SHOULDER HOLD-DOWN AND LOCKING MECHANISM THEREFOR FOR USE WITH A SURGICAL FRAME

FIELD

The present technology is generally related to a shoulder hold-down and a locking mechanism therefor for use with a surgical frame.

BACKGROUND

Surgical frames have been used to position and reposition a patient during surgery. For example, surgical frames have been configured to manipulate the rotational position of the patient before, during, and even after surgery. Such surgical frames include support structures to facilitate the rotational movement of the patient. Typical support structures can include main beams supported at either ends thereof for rotational movement about axes of rotation extending along the lengths of the surgical frames. The main beams can be positioned and repositioned to afford various positions of a patient positioned thereon. To illustrate, the main beams can be rotated for positioning a patient in prone positions, lateral positions, and positions 45° between the prone and lateral positions. However, given the rotational movement of the main beams, there is a desire for one or more shoulder hold-downs used in securing a shoulder or shoulders of the patient in position during such rotation.

SUMMARY

The techniques of this disclosure generally relate to one or more shoulder hold-downs and/or locking mechanisms therefor used for securing the shoulder or shoulders of a patient in position to facilitate rotational positioning and repositioning of the patient using a surgical frame.

In one aspect, the present disclosure provides a locking mechanism for use with a surgical frame, the locking mechanism including an arm portion including a first shaft portion, a second shaft portion, and a first flange portion, the arm portion including a first end, an opposite second end, a mid-longitudinal axis extending through the first end and the second end, and a channel extending from at least adjacent the first end to at least adjacent the second end along the mid-longitudinal axis, the channel receiving portions of the second shaft portion therein, the first shaft portion including a first exterior surface, the second shaft portion including a second exterior surface, the first shaft portion adjacent the first end of the arm portion including a first aperture on a first side of the channel, the first shaft portion adjacent the first end of the arm portion including a second aperture on a second side of the channel, and the second shaft portion adjacent the first end of the arm portion including a third aperture; a handle portion having a clevis portion including a first lateral portion and a second lateral portion, the first lateral portion and the second lateral portion of the handle portion being spaced apart from one another, the first lateral portion of the handle portion including a fourth aperture and a first cam surface formed thereon, and the second lateral portion of the handle portion including a fifth aperture and a second cam surface formed thereon, end portions of each of the first shaft portion and the second shaft portion adjacent the first end of the arm portion being received between the first lateral portion and the second lateral portion of the clevis portion; a bracket portion and a second flange portion, the bracket portion including at least a third lateral portion and a fourth lateral portion, the third lateral portion and the fourth lateral portion of the bracket portion being spaced apart from one another, the second flange portion being positioned between the third lateral portion and the fourth lateral portion of the bracket portion, the third lateral portion of the bracket portion including a sixth aperture, and the fourth lateral portion of the bracket portion including a seventh aperture, the first lateral portion and the second lateral portion of the handle portion being received between the third lateral portion and the fourth lateral portion of the bracket portion; and one of a rod and a fastener extending through the first aperture, the second aperture, the third aperture, the fourth aperture, the fifth aperture, the sixth aperture, and the seventh aperture to attach the arm portion, the bracket portion, and the handle portion to one another; where the first cam surface and the second cam surface of the handle portion are contactable to at least one surface of the first flange portion, and movement of the handle portion from an unactuated position to an actuated position causes the first cam surface and the second cam surface to translate on the at least one surface, and simultaneously move the first contact surface of the first flange and the second contact surface of the second flange toward one another, and move the second shaft portion at least partially out of the channel in the first shaft portion to expand the first shaft portion and the second shaft portion relative to one another via interaction of the one of the rod and the fastener in the first aperture, the second aperture, the third aperture, the fourth aperture, the fifth aperture, the sixth aperture, and the seventh aperture.

In another aspect, the disclosure provides a locking mechanism for use with a surgical frame, the locking mechanism including an arm portion including a first shaft portion, a second shaft portion, and a first flange portion, the arm portion including a first end, an opposite second end, a mid-longitudinal axis extending through the first end and the second end, and a channel extending from at least adjacent the first end to at least adjacent the second end along the mid-longitudinal axis, portions of the second shaft portion being moveable into and out of the channel, the first shaft portion including a first exterior surface, the second shaft portion including a second exterior surface, the first shaft portion adjacent the first end of the arm portion including a first aperture on a first side of the channel, the first shaft portion adjacent the first end of the arm portion including a second aperture on a second side of the channel, and the second shaft portion adjacent the first end of the arm portion including a third aperture; a handle portion having a clevis portion including a first lateral portion and a second lateral portion, the first lateral portion and the second lateral portion of the handle portion being spaced apart from one another, the first lateral portion of the handle portion including a fourth aperture and a first cam surface formed thereon, and the second lateral portion of the handle portion including a fifth aperture and a second cam surface formed thereon; a bracket portion and a second flange portion, the bracket portion including at least a third lateral portion and a fourth lateral portion, the third lateral portion and the fourth lateral portion of the bracket portion being spaced apart from one another, the second flange portion being positioned between the third lateral portion and the fourth lateral portion of the bracket portion, the third lateral portion of the bracket portion including a sixth aperture, and the fourth lateral portion of the bracket portion including a seventh aperture; and one of a rod and a fastener extending through the first aperture, the second aperture, the third aperture, the fourth aperture, the fifth aperture, the sixth aperture, and the seventh aperture to attach the arm portion, the bracket portion, and the handle portion to one another; where, when the locking mechanism is assembled, the portions of the second shaft portion are received in the channel of the first shaft portion, end portions of each of the first shaft portion and the second shaft portion adjacent the first end of the arm portion being received between the first lateral portion and the second lateral portion of the handle portion, and the first lateral portion and the second lateral portion of the handle portion being received between the third lateral portion and the fourth lateral portion of the bracket portion, and where the first cam surface and the second cam surface of the handle portion are contactable to at least one surface of the first flange portion, and movement of the handle portion from an unactuated position to an actuated position causes the first cam surface and the second cam surface to translate on the at least one surface, and simultaneously move the first contact surface of the first flange and the second contact surface of the second flange toward one another, and move the second shaft portion at least partially out of the channel in the first shaft portion to expand the first shaft portion and the second shaft portion relative to one another.

In yet another aspect, the disclosure provides a shoulder hold-down for use in securing at least a shoulder of a patient in position relative to a surgical frame, the shoulder hold-down including a support shaft portion including a first end, an opposite second end, and being configured to be received between the first contact surface and the second contact surface of the locking mechanism; a shoulder engaging portion being attached to the first end of the support shaft portion, and including a shoulder contacting structure configured to contact at least the shoulder of the patient; and a locking mechanism including: an arm portion including a first shaft portion, a second shaft portion, and a first flange portion, the arm portion including a first end, an opposite second end, a mid-longitudinal axis extending through the first end and the second end, and a channel extending from at least adjacent the first end to at least adjacent the second end along the mid-longitudinal axis, the channel receiving portions of the second shaft portion therein, the first shaft portion including a first exterior surface, the second shaft portion including a second exterior surface, the first shaft portion adjacent the first end of the arm portion including a first aperture on a first side of the channel, the first shaft portion adjacent the first end of the arm portion including a second aperture on a second side of the channel, and the second shaft portion adjacent the first end of the arm portion including a third aperture; a handle portion having a clevis portion including a first lateral portion and a second lateral portion, the first lateral portion and the second lateral portion of the handle portion being spaced apart from one another, the first lateral portion of the handle portion including a fourth aperture and a first cam surface formed thereon, and the second lateral portion of the handle portion including a fifth aperture and a second cam surface formed thereon, end portions of each of the first shaft portion and the second shaft portion adjacent the first end of the arm portion being received between the first lateral portion and the second lateral portion of the clevis portion; a bracket portion and a second flange portion, the bracket portion including at least a third lateral portion and a fourth lateral portion, the third lateral portion and the fourth lateral portion of the bracket portion being spaced apart from one another, the second flange portion being positioned between the third lateral portion and the fourth lateral portion of the bracket portion, the third lateral portion of the bracket portion including a sixth aperture, and the fourth lateral portion of the bracket portion including a seventh aperture, the first lateral portion and the second lateral portion of the handle portion being received between the third lateral portion and the fourth lateral portion of the bracket portion; and one of a rod and a fastener extending through the first aperture, the second aperture, the third aperture, the fourth aperture, the fifth aperture, the sixth aperture, and the seventh aperture to attach the arm portion, the bracket portion, and the handle portion to one another; where the support shaft portion is received between the first contact surface of the first flange and the second contact surface of the second flange, and where the first cam surface and the second cam surface of the handle portion are contactable to at least one surface of the first flange portion, and movement of the handle portion from an unactuated position to an actuated position causes the first cam surface and the second cam surface to translate on the at least one surface, and move the first contact surface of the first flange and the second contact surface of the second flange toward one another to impinge on the support shaft and hold the support shaft in position, and move the second shaft portion at least partially out of the channel in the first shaft portion to expand the first shaft portion and the second shaft portion relative to one another via interaction of the one of the rod and the fastener in the first aperture, the second aperture, the third aperture, the fourth aperture, the fifth aperture, the sixth aperture, and the seventh aperture.

The details of one or more aspects of the disclosure as set forth in the accompanying drawings and the description below. Other features, objects, and advantages of the techniques described in this disclosure will be apparent from the description and drawings, and from the claims.

DETAILED DESCRIPTION

Figure 1:
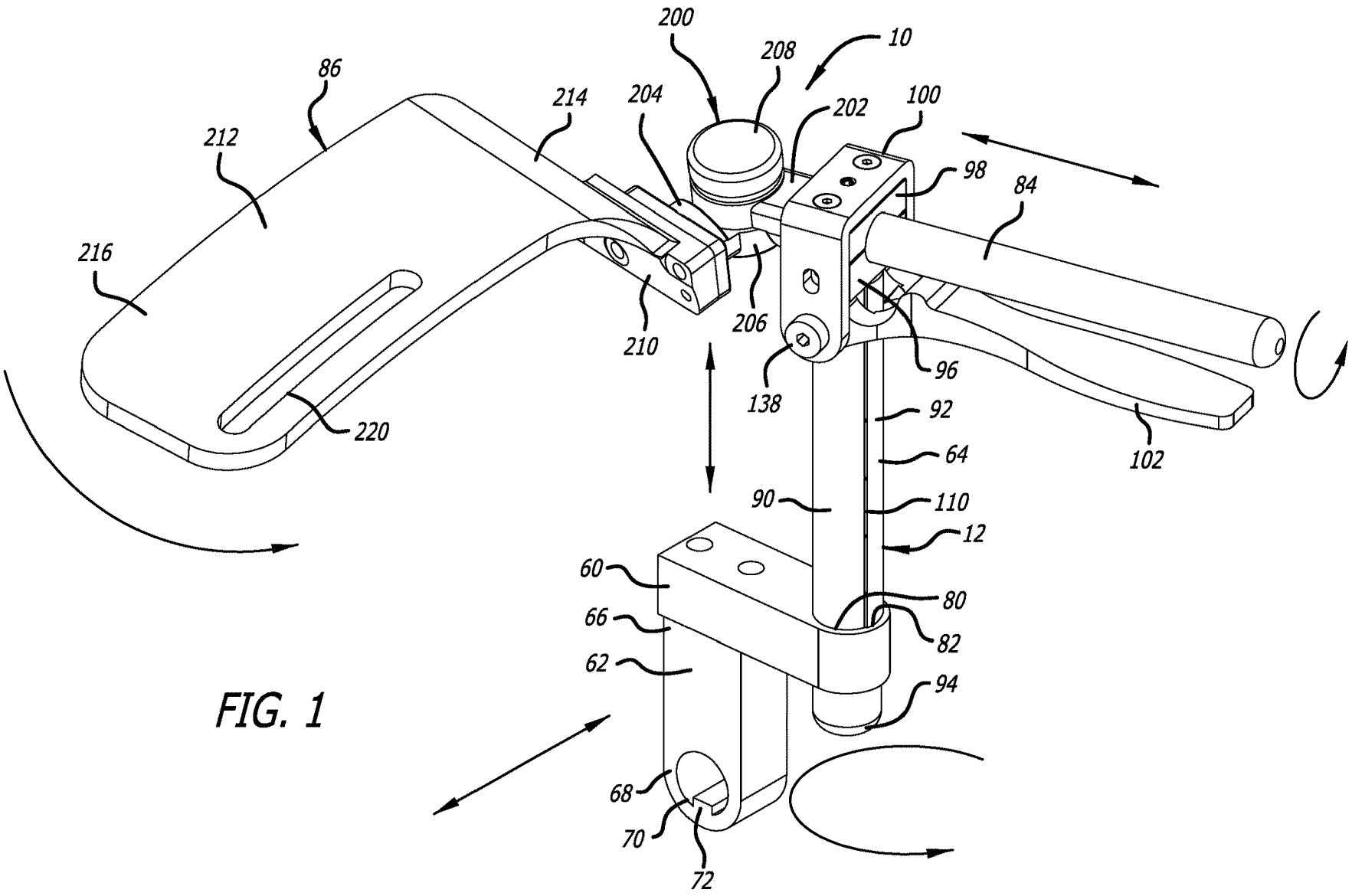
FIG. 1 is a top, side perspective view that illustrates an embodiment of a shoulder hold-down.
Figure 2:
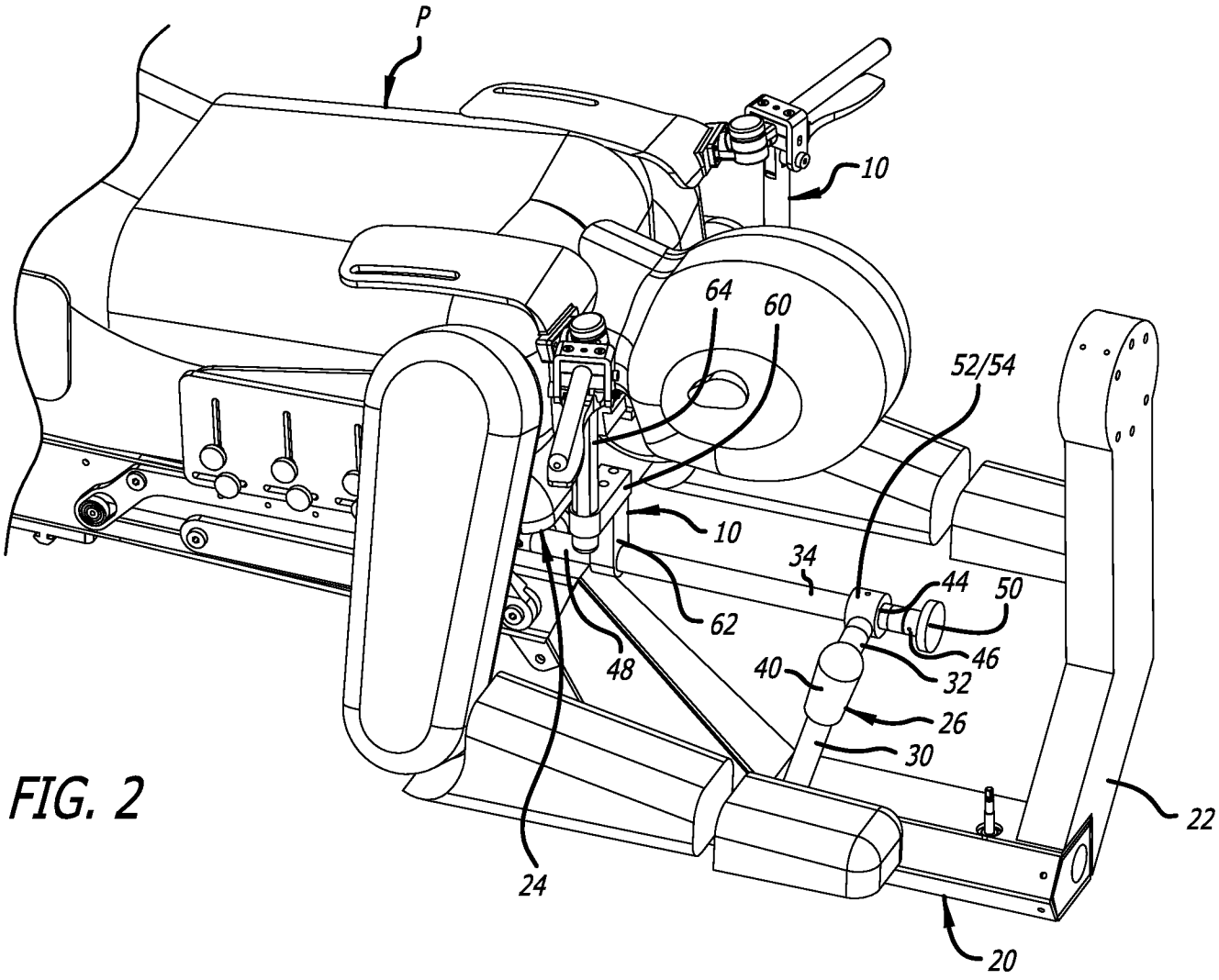
FIG. 2 is a top, side perspective view that illustrates a portion of a surgical frame 20 incorporating a first one and a second one of the shoulder hold-down of FIG. 1.

Shoulder hold-downs according to a preferred embodiment of the present disclosure are generally indicated by the numeral 10 in FIGS. 1 and 2. Each of the shoulder hold-downs 10 includes a locking mechanism 12 facilitating at least four (4) modes of adjustment and for locking the adjusted portions of each of the shoulder hold-downs 10 in position. The locking mechanism 12 is not limited to use with the shoulder hold-downs 10, and can be used in other environments. As discussed below, the shoulder hold-downs 10 are for holding the right shoulder and the left shoulder of a patient P and portions of the patient's back in position relative to a surgical frame 20.

The shoulder hold-downs 10 can be used with surgical frames such as that disclosed in U.S. application Ser. Nos. 15/239,256, 15/639,080 and 15/672,005, which are hereby incorporated by reference in their entireties. As such, the shoulder hold-downs 10 can used with a surgical frame 20 that is similar to those of the above-referenced U.S. application Nos., of which portions are depicted in FIG. 2. The shoulder hold-downs 10 are used in conjunction with other componentry of the surgical frame 20 to secure the patient P in position on the surgical frame 20 to facilitate rotation of the patient P by the surgical frame 20. More specifically, the shoulder hold-downs 10 are used in holding the right shoulder and the left shoulder in position relative to the surgical frame 20. As depicted in FIG. 2, a first one of the shoulder hold-downs 10 is positioned on the right side of the patient P, and a second one of the shoulder hold-downs 10 is positioned on the left side of the patient P. Furthermore, to facilitate use of the first one and the second one of the shoulder hold-downs 10 on opposite lateral sides of the patient P, componentry of the shoulder hold-downs 10 can be mirrored with respect to one another.

As depicted in FIG. 2, the surgical frame 20 includes a main beam 22, a chest support portion 24 supported by the main beam 22, and adjustable arm portions 26 also supported by the main beam 22. The chest support portion 24 is used for supporting portions of the torso (including the chest) of the patient P relative to the main beam 22, and the adjustable arm portions 26 are used to facilitate positioning of the shoulder hold-downs 10 relative to the patient P. Furthermore, although only one of the adjustable arm portions 26 is depicted in FIG. 2 supporting the first one of the shoulder hold-downs 10 on the right side of the patient P, another of the adjustable arm portions 26 can be positioned on the left side of the patient P to support the second one of the shoulder hold-downs 10.

The main beam 22 can support other componentry (such as, for example, hip support(s) and/or leg support(s) (not shown)) for supporting portions of the patient P relative to the main beam 22. Likewise, the adjustable arm portions 26 (supported by the main beam 22) can support other componentry (such as, for example, head support(s) (not shown) for supporting portions of the patient P relative to the main beam 22.

The adjustable arm portion 26, as depicted in FIG. 2, includes a first arm portion 30, a second arm portion 32, and a third arm portion 34. Although the attachment thereof is not shown in FIG. 2, the first arm portion 30 is attachable relative to the main beam 22. The attachment of the first arm portion 30 to the main beam 22 can be fixed, or the attachment of the first arm portion 30 to the main beam 22 can be moveable to facilitate positioning of the first arm portion 30 relative to the main beam 22. The first arm portion 30 includes a first hub portion 40 at an end thereof opposite from the attachment to the main beam 22.

Although the attachment thereof is not shown in FIG. 2, the second arm portion 32 is attachable relative to the first hub portion 40. The attachment of the second arm portion 32 to the first hub portion 40 can be fixed, or the attachment of the second arm portion 32 to the first hub portion 40 can be moveable to facilitate positioning of the second arm portion 32 relative to the first arm portion 30. For example, the moveable attachment of the second arm portion 32 relative to the first hub 40 can facilitate rotation of the second arm portion 32 relative to the first arm portion 30. The second arm portion 32 includes a second hub portion 42 at an end thereof opposite from the attachment to the first hub portion 40.

The second hub portion 42, as depicted in FIG. 2, can be fixedly or moveably attached to the second arm portion 32, and includes an aperture 44 therein for receiving the third arm portion 34 therethrough. The moveable attachment of the second hub portion 42 relative to the second arm portion 32 can facilitate rotation of the third arm portion 34 relative to the second arm portion 32. Furthermore, the receipt of the third arm portion 34 in the aperture 44 facilitates movement of a first end portion 46 and a second end portion 48 of the third arm portion 34 toward and away from the patient P. The third arm portion 34 can include one or more stops 50 provided at the first end portion 46 and/or the second end portion 48 for preventing withdrawal of the third arm portion 34 from the aperture 44 of the second hub portion 42. Also, a set screw 52 can be received in an aperture 54 in the second hub portion 42 to impinge on the third arm portion 34 to maintain the position of the third arm portion 34 with respect to the second hub portion 42.

The first one of the shoulder hold-downs 10, as depicted in FIG. 2, is moveable toward and away from the patient P along the third arm portion 34 of the adjustable arm portion 26 positioned on the right side of the patient P. Likewise, the second one of the shoulder hold-downs 10 would be moveable toward and away from the patient P along the third arm portion 34 of the adjustable arm portion 26 positioned on the left side of the patient P.

As depicted in FIG. 1, the shoulder hold-down 10 includes a base portion 60, a leg portion 62 depending downwardly from the base portion 60, and an arm portion 64 moveable upwardly and downwardly with respect to the base portion 60. The shoulder hold-down 10 depicted in FIG. 1 is also depicted in FIG. 2 as the first one of the shoulder hold-downs 10 on the right side of the patient P. The second one of the shoulder hold-downs 10 on the left side of the patient P in FIG. 2 can have componentry (such as the base portion 60, the leg portion 62, and the arm portion 64) that is mirrored with respect to the shoulder hold-down 10 on the right side of the patient P.

The leg portion 62 of the shoulder hold-down 10 includes a first end 66 and a second end 68. The leg portion 62 at the first end 66 is fixedly attached to the base portion 60 via fasteners (not shown) or other attachment mechanism such as adhesives, brazing, and/or welding. Furthermore, the leg portion 62 at the second end 68 includes an opening 70 for receiving the third arm portion 34 of the adjustable arm portion 26 therethrough.

One of the opening 70 and the third arm portion 34 can include a key, and the other of the opening 70 and the third arm portion 34 can include a keyway. As depicted in FIG. 1, the opening 70 includes a key 72 receivable in a keyway (not shown) formed in the third arm portion 34. If one of the opening 70 and the third arm portion 34 include the key 72 and the other of the opening 70 and the third arm portion 34 include the keyway, the leg portion 62 would not be rotatable on the third arm portion 34. If the key 72 and the keyway are not provided, the leg portion 62 could rotate on the third arm portion 34. Also, a set screw (not shown) can be received in an aperture (not shown) in the base portion 60 to impinge on the third arm portion 34 to maintain the position of the base portion 60 with respect to the third arm portion 34.

The base portion 60, as depicted in FIG. 1, includes an opening 80 for receiving portions of the arm portion 64 therein. The opening 80 includes an interior surface 82, and the arm portion 64 is moveable upwardly and downwardly with respect to the base portion 60 via travel thereof in the opening 80. The arm portion 64 is part of the locking mechanism 12, and the locking mechanism 12 is used both for fixing the position of the arm portion 64 relative to the base portion 60, and for fixing the position of a support shaft portion 84. As discussed below, the support shaft portion 84 supports a shoulder engaging portion 86, and both the support shaft portion 84 and the shoulder engaging portion 86 are also part of the shoulder hold-down 10.

Figure 3:
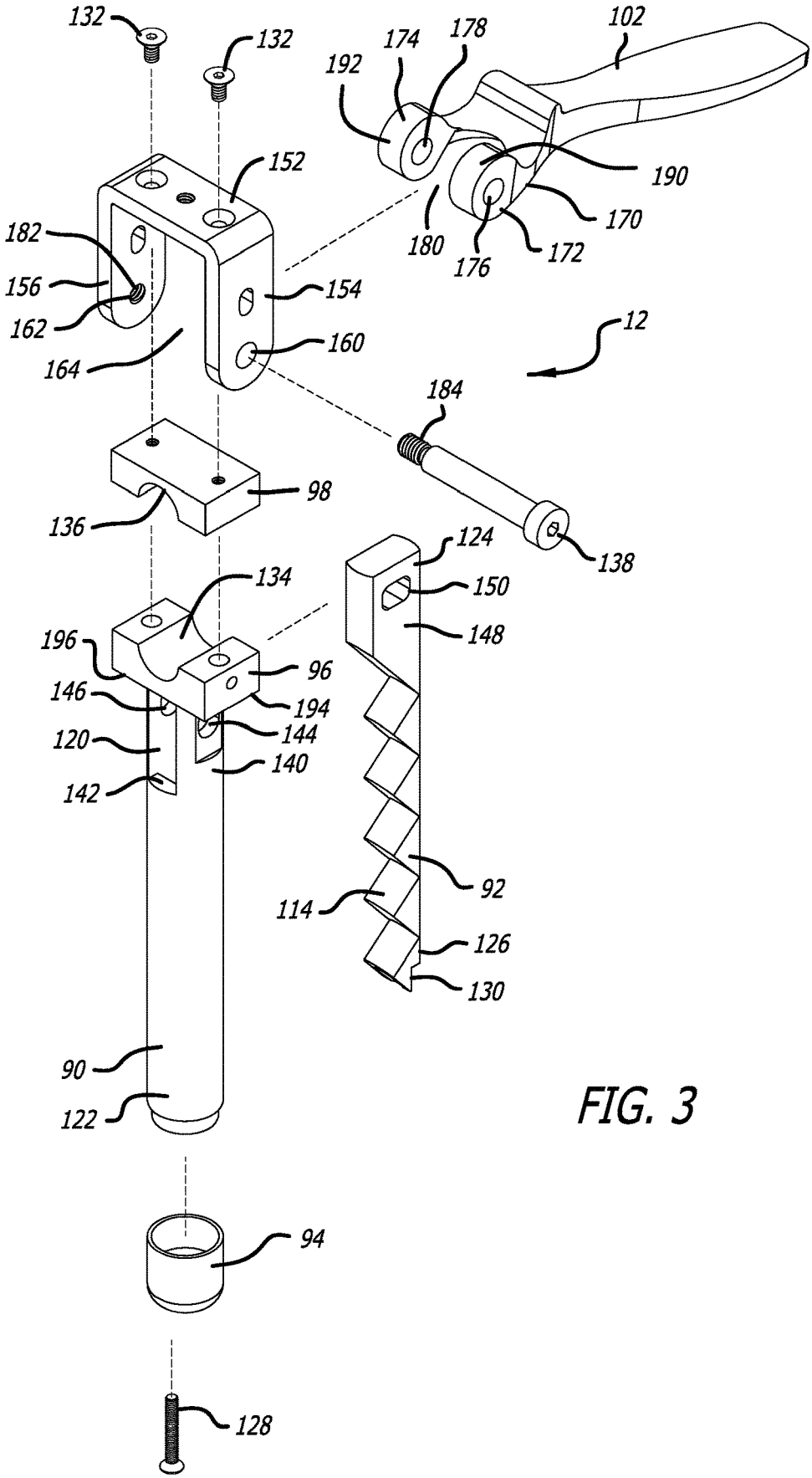
FIG. 3 is a top, side exploded view that illustrates a locking mechanism of the shoulder hold-down.

As depicted in FIG. 3, the arm portion 64 includes a first shaft portion 90, a second shaft portion 92, a cap portion 94, and a first flange portion 96. As discussed below, a second flange portion 98, a bracket portion 100, and a handle portion 102 are attached relative to the arm portion 64.

Figure 4:
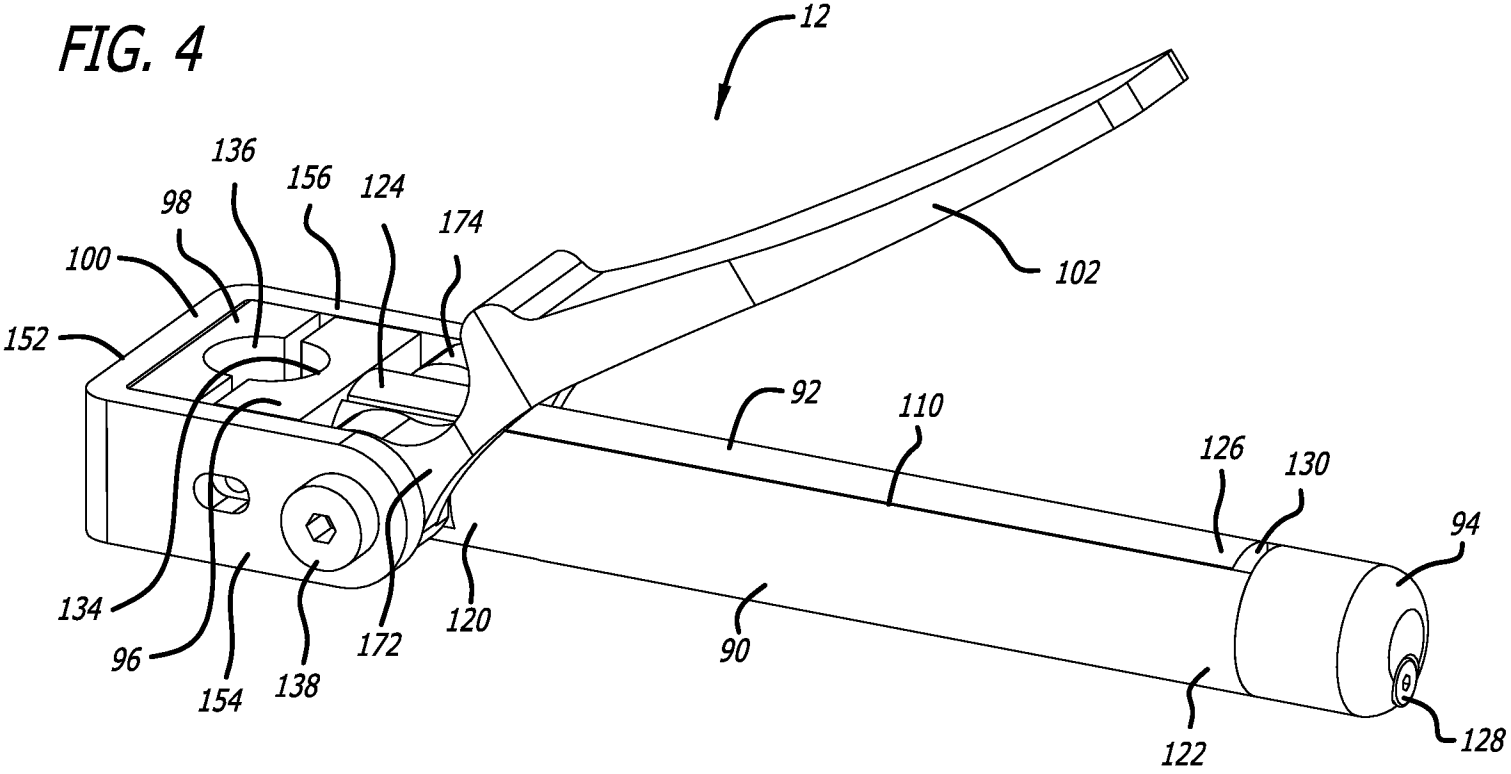
FIG. 4 is a side perspective view that illustrates the locking mechanism of FIG. 1 in an unactuated position.
Figure 5:
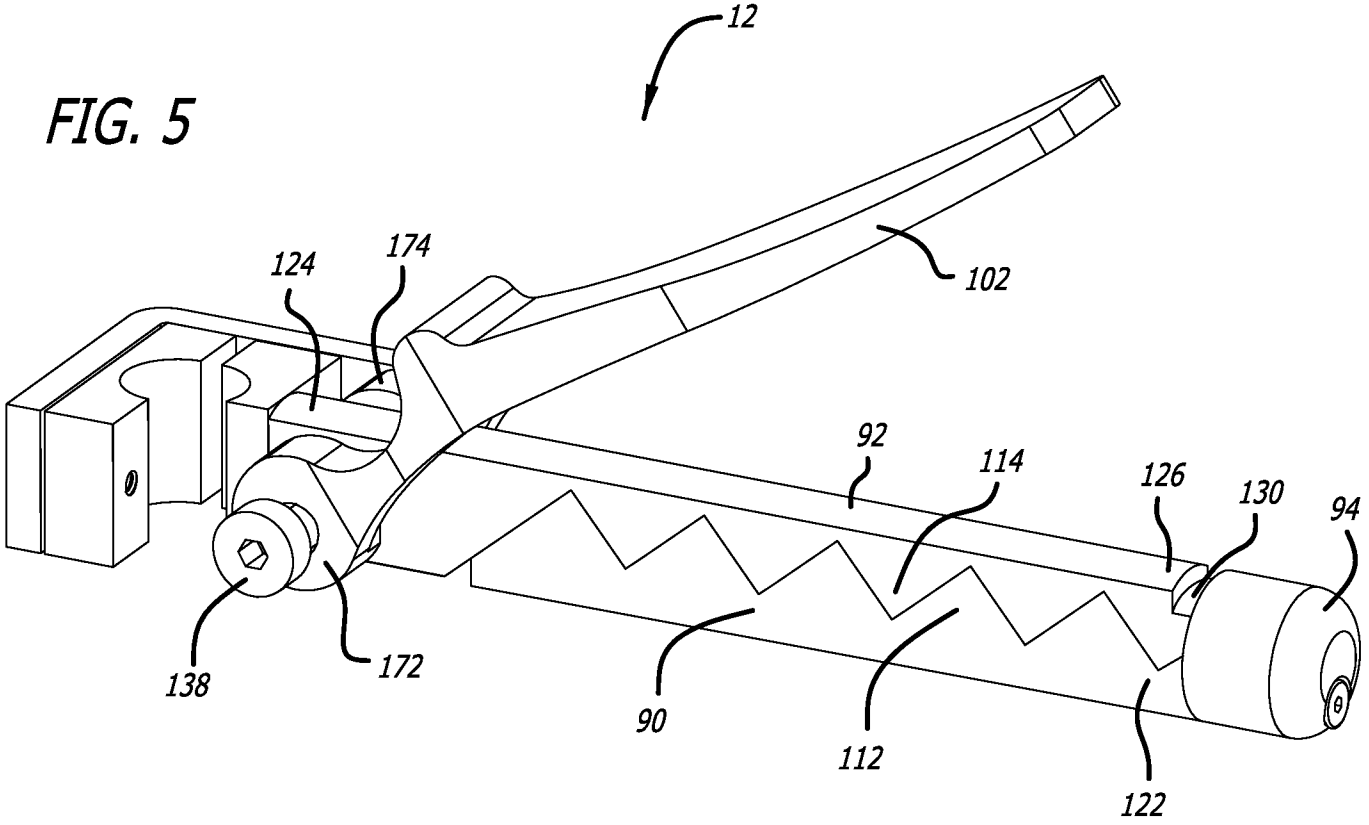
FIG. 5 is a side, cutaway perspective view of the locking mechanism similar to FIG. 4 that illustrates portions of the locking mechanism in the unactuated position.
Figure 6:
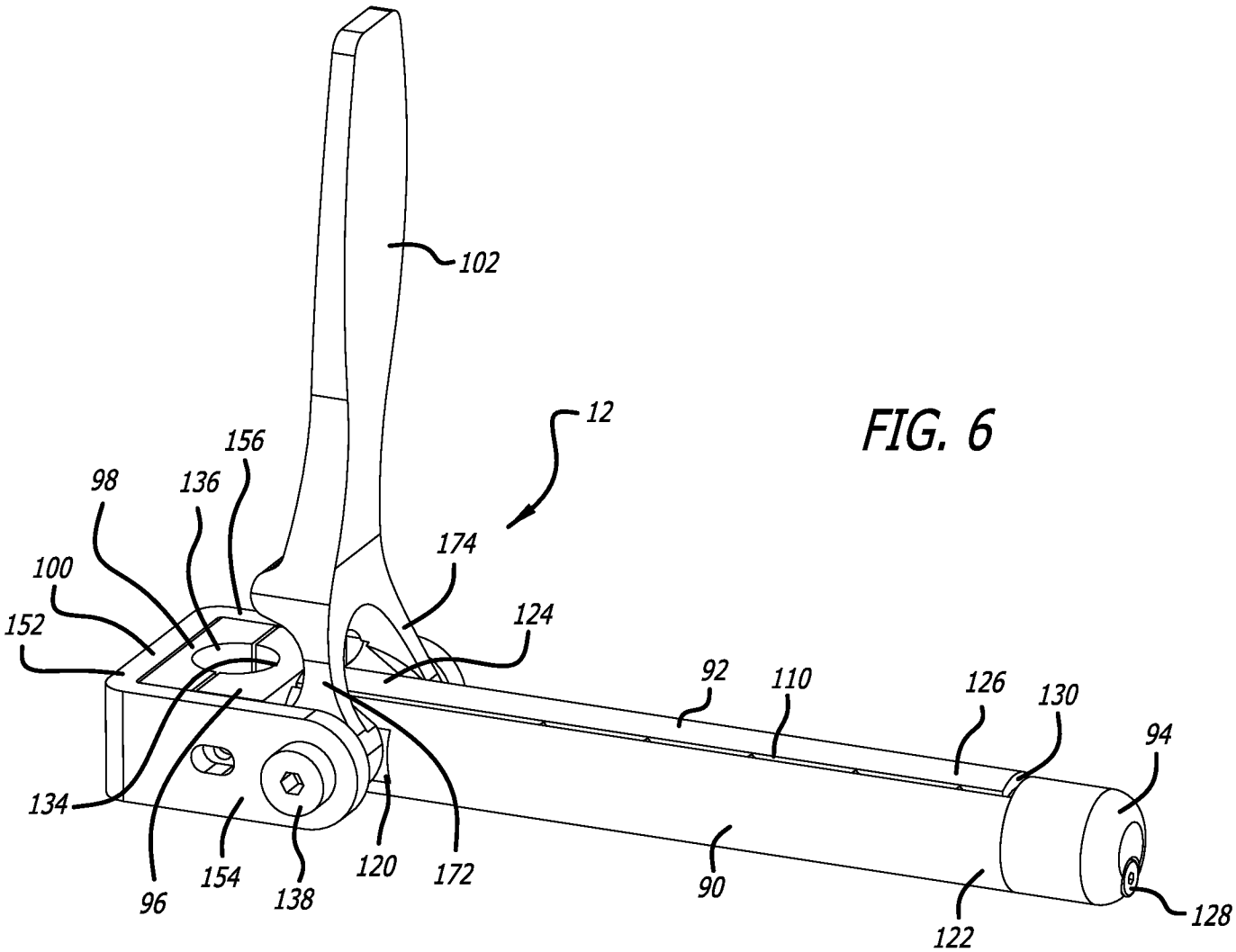
FIG. 6 is a side perspective view that illustrates the locking mechanism of FIG. 1 is an actuated position.
Figure 7:
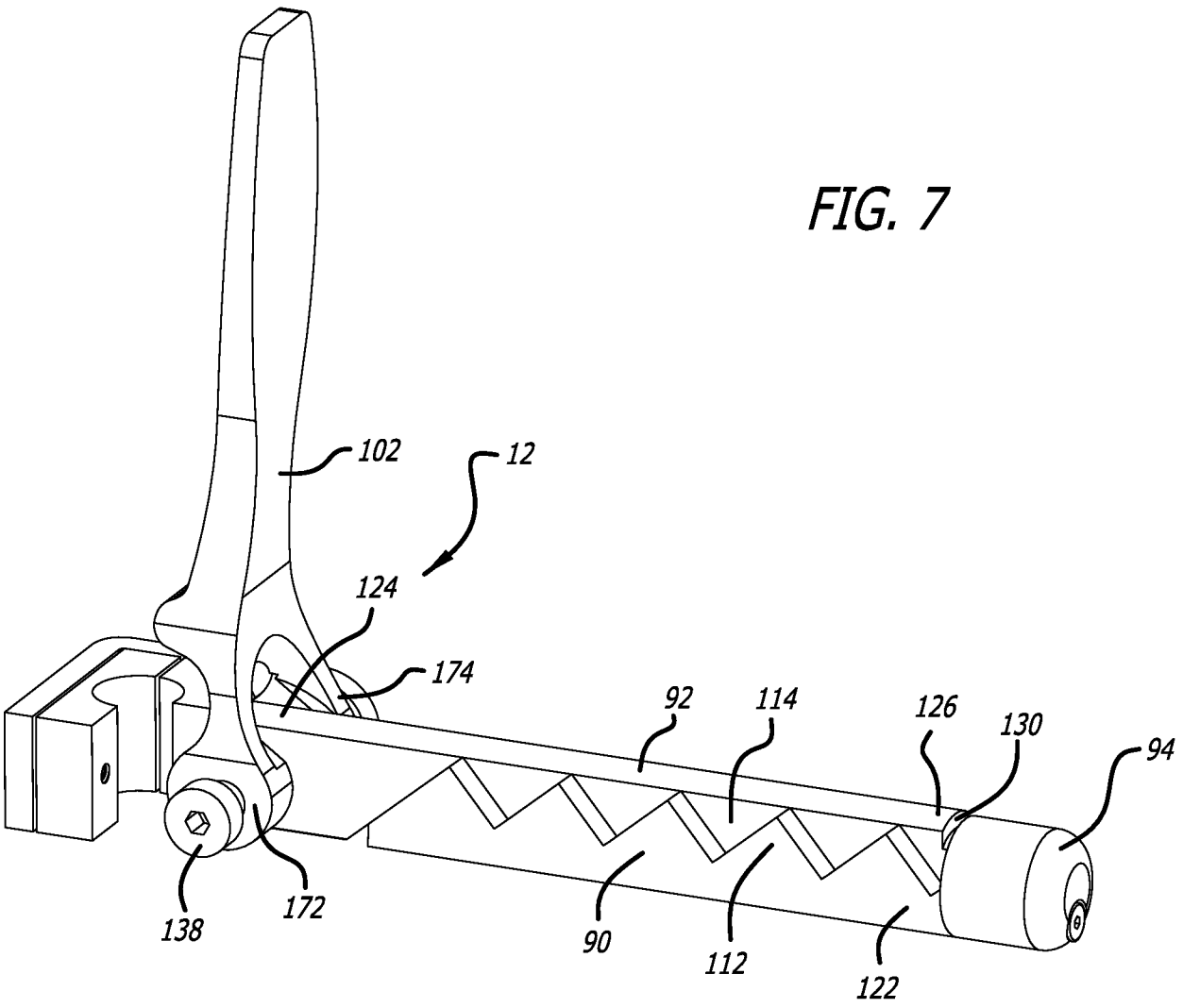
FIG. 7 is a side, cutaway perspective view of the locking mechanism similar to FIG. 6 that illustrates portions of the locking mechanism in the actuated position.

As depicted in FIGS. 1, 4, and 6, the first shaft portion 90 includes a channel 110 for receiving the second shaft portion 92. Furthermore, as depicted in FIGS. 3, 5, and 7, the first shaft portion 90 includes first teeth 112 formed in the channel 110, and the second shaft portion 92 includes second teeth 114 formed thereon. The first teeth 112 and the second teeth 114 are engageable to one another, and, as discussed below, movement of the second teeth 114 on the first teeth 112 causes the second shaft portion 92 to move outwardly from the channel 110. In doing so, the first shaft portion 90 and the second shaft portion 92 are expanded with respect to one another due to the contact of the first teeth 112 and the second teeth 114 sliding on each other. The first shaft portion 90 includes at least a first exterior surface 116 and the second shaft portion 92 includes at least a second exterior surface 118.

As discussed below, operation of the locking mechanism 12 causes the second shaft portion 92 to move from a retracted position within the channel 110 to a position partially out of the channel 110, and expand the first shaft portion 90 and the second shaft portion 92 with respect to one another. Thus, as the first shaft portion 90 and the second shaft portion 92 are expanded, the first exterior surface 116 and the second exterior surface 118 are pressed against portions of the interior surface 82 of the opening 80 to hold the first shaft portion 90 and the second shaft portion 92 in position relative to the base portion 60.

The first shaft portion 90 includes a first end 120 and a second end 122, and the second shaft portion 92 includes a first end 124 and a second end 126. As depicted in FIGS. 3, 5 and 7, the first end 120 of the first shaft portion 90 and the first end 124 of the second shaft portion 92 are received in an internal cavity of the cap portion 94, and the cap portion 94 is attached to the first shaft portion 90 using a fastener 128. The second end 126 of the second shaft portion 92 includes an indentation 130 which affords movement of the second shaft portion 92 out of the channel 110.

As depicted in FIG. 2, the first flange portion 96 is fixedly attached to the first shaft portion 90 via adhesives, fasteners, brazing, and/or welding, the second flange portion 98 is fixedly attached to the bracket portion 100 via fasteners 132 or other attachment mechanism such as adhesives, brazing, and/or welding. Alternatively, the first flange portion 96 can be integrally formed with the first shaft portion 90, and the second flange portion 98 can be integrally formed with the bracket portion 100. The first flange portion 96 and the second flange portion 98 include a first contact surface 134 and a second contact surface 136, respectively. As discussed below, operation of the locking mechanism 12 causes clamping of the support shaft portion 84 between the first contact surface 134 and the second contact surface 136, and holds the support shaft portion 84 in position relative to the arm portion 64.

The second shaft portion 92, the bracket portion 100, and a handle portion 102 are attached to the first shaft portion 90 using a fastener or rod 138. The handle portion 102 is also part of the locking mechanism 12, and actuation of the handle portion 102 operates the locking mechanism to cause the second shaft portion 92 to move out of the channel 110 to expand the first shaft portion 90 and the second shaft portion 92 with respect to one another, and to cause clamping of the support shaft portion 84 between the first contact surface 134 and the second contact surface 136 to hold the support shaft portion 84 in position relative to the arm portion 64.

To facilitate attachment thereof using the fastener 138, the first shaft portion includes an end portion 140 at the second end 122 thereof including a groove 142 communicating with the channel 110, a first aperture 144 in the end portion 140 on one side of the groove 142, and a second aperture 146 in the end portion 140 on the other side of the groove 142; the second shaft portion includes an end portion 148 at the second end 126 thereof including an aperture 150; the bracket portion 100 includes a connecting portion 152, a first lateral portion 154, a second lateral portion 156, a first opening 160 in the first lateral portion 154, a second opening 162 in the second lateral portion 156, and a gap 164 between the first lateral portion 154 and the second lateral portion 156; and the handle portion 102 includes a clevis portion 170 including a first lateral portion 172, a second lateral portion 174, a first opening 176 in the first lateral portion 172, a second opening 178 in the second lateral portion 174, and a gap 180 between the first lateral portion 172 and the second lateral portion 174.

To assemble the first shaft portion 90, the second shaft portion 92, the bracket portion 100, and the handle portion H, the second shaft portion 92 is received in the channel 110 and the end portion 148 of the second shaft portion 92 is received in the groove 142 formed in the end portion 140 of the first shaft portion 90; the end portion 140 of the first shaft portion 90 is received in the gap 180 between the first lateral portion 172 and the second lateral portion 174; and the clevis portion 170 is received in the gap 164 between the first lateral portion 154 and the second lateral portion 156 of the bracket portion 100.

In doing so, the first aperture 144 and the second aperture 146 in the first shaft portion 90, the aperture 150 in the second shaft portion 92, the first opening 160 and the second opening 162 in the bracket portion 100, and the first opening 176 and the second opening 178 in the clevis portion 170 are aligned with one another.

The fastener 138 is inserted in these openings and apertures to attach the first shaft portion 90, the second shaft portion 92, the bracket portion 100, and the handle portion 102 to one another. One of the first opening 160 and the second opening 162 in the bracket portion 100 can include threads for engaging complimentary threads on the fastener 138 to hold the first shaft portion 90, the second shaft portion 92, the bracket portion 100, and the handle portion 102 together. Alternately, a nut having threads can be engageable to complimentary threads on the fastener 138 to hold the first shaft portion 90, the second shaft portion 92, the bracket portion 100, and the handle portion 102 together. As depicted in FIG. 3, the second opening 162 in the bracket portion 100 includes threads 182 formed therein, and the fastener 138 includes threads 184 formed therein. As such, to hold these components together, the fastener 138 is inserted through the first opening 160 in the bracket portion 100, through the first opening 176 in the handle portion H, through the first aperture 144 in the first shaft portion 90, through the aperture 150 in the second shaft portion 92, through the second aperture 146 in the first shaft portion 90, through the second opening 178 in the handle portion H, into the second opening 162 in the bracket portion 100, and the threads 184 are engaged to the threads 182 in the second opening 162.

Each of the first aperture 144 and the second aperture 146 in the first shaft portion 90, and the aperture 150 in the second shaft portion 92 are oblong, and correspondingly afford play between componentry of the locking mechanism 12. For example, the longitudinal axes of the first aperture 144 and the second aperture 146 in the first shaft portion 90 are oriented vertically as seen in FIG. 3, and such an orientation affords leftward and rightward movement, as depicted in FIGS. 4-7, of the second shaft portion 92, the bracket portion 100, and the handle portion 102 via interplay of the fastener 138 in the various openings and apertures of the components of the locking mechanism 12. Furthermore, the longitudinal axis of the aperture 150 in the second shaft portion 92 is oriented horizontally as seen in FIG. 3, and such an orientation affords inward and outward movement, as depicted in FIGS. 4-7, of the second shaft portion 92 relative to the channel 110 via interplay of the fastener 138 in the various openings and apertures of the components of the locking mechanism 12.

FIGS. 4 and 5 depict the handle portion 102 in an unactuated position, and FIGS. 6 and 7 depict the handle portion 102 in an actuated position. When the handle portion 102 is in the unactuated position (FIGS. 4 and 5), the first flange portion 96 and the second flange portion 98 are spaced apart from one another, and the second shaft portion 92 is in the retracted position within the channel 110. Furthermore, when the handle portion 102 is in an actuated position (FIGS. 6 and 7), the first flange portion 96 and the second flange portion 98 are contacted to one another, and the second arm portion 92 is in the position partially out of the channel 110.

The interaction of portions of the handle portion 102 with the first flange portion 96 via actuation thereof moves the first flange portion 96 and the second flange portion 98 from the position depicted in FIGS. 4 and 5 to the position depicted in FIGS. 6 and 7, and moves the second shaft portion 92 from the position depicted in FIGS. 4 and 5 to the position depicted in FIGS. 6 and 7. Such movement is facilitated by the contact of a first cam surface 190 formed on the first lateral portion 172 and a second cam surface 192 formed on the second lateral portion 174 with a first contact surface 194 and a second contact surface 196 formed on the underside of the first flange portion 96, as depicted in FIG. 3-7.

As the handle portion 102 is moved from the unactuated position to the actuated position, the contact of the first cam surface 190 with the first contact surface 194, and the contact of the second cam surface 192 with the second contact surface 196 causes rightward movement, as depicted in FIGS. 4-7, of the fastener 138 which in turn causes rightward movement of the bracket portion 100 and the second shaft portion 92 relative to the first shaft portion 90 that is afforded by the orientation of the first aperture 144 and the second aperture 146. Rightward movement of the bracket portion 100 forces the first flange portion 96 and the second flange portion 98 together, as depicted in FIGS. 6 and 7. Furthermore, rightward movement of the second shaft portion 92 causes the second teeth 114 to slide along the first teeth 112 that is afforded by the orientation of the aperture 150. The sliding of the second teeth 114 over the first teeth 112 moves the second shaft portion 92 from the retracted position within the channel 110 to the position partially out of the channel 110, and expands the first shaft portion 90 and the second shaft portion 92 with respect to one another.

Operation of the locking mechanism 12 via actuation of the handle portion 102 facilitates clamping of the support shaft portion 84 between the first contact surface 134 and the second contact surface 136 of the first flange portion 96 and the second flange portion 98, respectively, to lock the support shaft portion 84 in position relative to the arm portion 64. And, operation of the locking mechanism 12 via actuation of the handle portion 102 facilitates movement of the second shaft portion 92 from the retracted position within the channel 110 to a position partially out of the channel 110, and correspondingly, presses the first exterior surface 116 and the second exterior surface 118 against portions of the interior surface 82 of the opening 80 to lock the first shaft portion 90 and the second shaft portion 92 in position relative to the base portion 60. As such, the locking mechanism 12 serves to lock the support shaft portion 84 in position, and also to lock the arm portion 64 in position. Thus, the locking mechanism 12 serves as a double-lock.

As discussed above, the support shaft 84 supports a shoulder engaging portion 86. The arm portion 64 can be moved with respect to the base portion 60, when not held in position via contact the first exterior surface 116 and the second exterior surface 118 against portions of the interior surface 82. Such movement affords two (2) modes of adjustment including slidable movement and axial rotation of the arm portion 64 within the opening 80. Thus, via operation of the locking mechanism 12, the shoulder engaging portion 86 supported by the arm portion 64 (via the locking mechanism 12 and the support shaft 84) is moveable upwardly and downwardly with respect to the patient P, and also rotatable with respect to the patient P.

Additionally, the support shaft 84 can be moved with respect to the locking mechanism 12, when not held in position via contact with the first contact surface 134 and the second contact surface 136. Such movement affords two (2) modes of adjustment including slidable movement and axial rotation of the support shaft 84 between the first contact surface 134 and the second contact surface 136. Thus, via operation of the locking mechanism 12, the shoulder engaging portion 86 supported by the support shaft 84 is moveable inwardly and outwardly with respect to the patient P, and also rotatable with respect to the patient P.

An additional mode of adjustment of the shoulder engaging portion 86 is afforded by a pivot bracket 200. The pivot bracket 200, as depicted in FIG. 1, includes a first portion 202, a second portion 204, a pivotal connection 206 between the first portion 202 and the second portion 204, and a knob portion 208. The first portion 202 is attached to the support shaft 84, and the second portion 204 is attached to the shoulder engaging portion 86. The pivot connection 206 affords pivotal movement between the first portion 202 and the second portion 204, and hence, affords pivotal movement of the shoulder engaging portion 86 relative to the support shaft 84. As such, in addition to the adjustment afforded by movement of the arm portion 64 and the support shaft 84, the pivot bracket 200 affords pivotal movement of the shoulder engaging portion 86.

The shoulder engaging portion 86 includes an attachment bracket 210 and a shoulder contacting structure 212. The attachment bracket 210 is attached to the second portion 204 of the pivot bracket 200, and supports the shoulder contacting structure 212 relative to the pivot bracket 200. The attachment bracket 210 can be integrally formed with the second portion 204 of the pivot bracket 200, or can be attached to the second portion 204 via fasteners (not shown) or other attachment mechanism such as adhesives, brazing, and/or welding.

The shoulder contacting structure 212 includes a first portion 214 and a second portion 216. As depicted in FIGS. 1 and 2, the curvatures of the first portion 214 and the second portion 216 are provided to conform to the typical shape and size of a patient's shoulder and back, respectively. To that end, the first portion 214 has a relatively large curvature such that the first portion 214 curves upwardly and extends away from the attachment bracket 210, and the second portion 216 has a relatively small curvature such that the second portion 216 is slightly curved and extends outwardly from the first portion 214.

The second portion 216 can include an aperture 220 therethrough for receiving straps (not shown) extending between the first one and/or the second one shoulder hold-downs 10 and the surgical frame 20. The straps can also be received through and extend between the apertures 220 of the first one and the second one of the shoulder hold downs 10. In doing so, the straps can be used in securing the torso of the patient P to the surgical frame 20.

Use of the first one and the second one of the shoulder hold-downs 10 serve to contact the right shoulder and the left shoulder, respectively, and portions of the patient's back to aid in securing the position of the patient P relative to the main beam 22. The modes of adjustment afford manipulation of the hold-downs 10 to facilitate positioning of the shoulder engaging portions 86 relative to the patient P. The positioning of the shoulder hold-downs 10 also is aided by movement thereof along the adjustable arm portions 26. When the shoulder hold-downs 10 are used with the other componentry for supporting portions of the patient P relative to the main beam 22, the main beam 22 can be rotated to position and reposition the patient P for surgery.

It should be understood that various aspects disclosed herein may be combined in different combinations than the combinations specifically presented in the description and the accompanying drawings. It should also be understood that, depending on the example, certain acts or events of any of the processes of methods described herein may be performed in a different sequence, may be added, merged, or left out altogether (e.g., all described acts or events may not be necessary to carry out the techniques). In addition, while certain aspect of this disclosure are described as being performed by a single module or unit for purposes of clarity, it should be understood that the techniques of this disclosure may be performed by a combination of units or modules associated with, for example, a medical device.

The invention claimed is:

1. A locking mechanism for use with a surgical frame, the locking mechanism comprising:

an arm portion including a first shaft portion, a second shaft portion, and a first flange portion, the arm portion including a first end, an opposite second end, a mid-longitudinal axis extending through the first end and the second end, and a channel extending from at least adjacent the first end to at least adjacent the second end along the mid-longitudinal axis, the channel receiving portions of the second shaft portion therein, the first shaft portion including a first exterior surface, the second shaft portion including a second exterior surface, the first shaft portion adjacent the first end of the arm portion including a first aperture on a first side of the channel, the first shaft portion adjacent the first end of the arm portion including a second aperture on a second side of the channel, and the second shaft portion adjacent the first end of the arm portion including a third aperture;

a handle portion having a clevis portion including a first lateral portion and a second lateral portion, the first lateral portion and the second lateral portion of the handle portion being spaced apart from one another, the first lateral portion of the handle portion including a fourth aperture and a first cam surface formed thereon, and the second lateral portion of the handle portion including a fifth aperture and a second cam surface formed thereon, end portions of each of the first shaft portion and the second shaft portion adjacent the first end of the arm portion being received between the first lateral portion and the second lateral portion of the clevis portion;

a bracket portion and a second flange portion, the bracket portion including at least a third lateral portion and a fourth lateral portion, the third lateral portion and the fourth lateral portion of the bracket portion being spaced apart from one another, the second flange portion being positioned between the third lateral portion and the fourth lateral portion of the bracket portion, the third lateral portion of the bracket portion including a sixth aperture, and the fourth lateral portion of the bracket portion including a seventh aperture, the first lateral portion and the second lateral portion of the handle portion being received between the third lateral portion and the fourth lateral portion of the bracket portion; and one of a rod and a fastener extending through the first aperture, the second aperture, the third aperture, the fourth aperture, the fifth aperture, the sixth aperture, and the seventh aperture to attach the arm portion, the bracket portion, and the handle portion to one another;

wherein the first cam surface and the second cam surface of the handle portion are contactable to at least one surface of the first flange portion, and movement of the handle portion from an unactuated position to an actuated position causes the first cam surface and the second cam surface to translate on the at least one surface, and simultaneously move the first contact surface of the first flange and the second contact surface of the second flange toward one another, and move the second shaft portion at least partially out of the channel in the first shaft portion to expand the first shaft portion and the second shaft portion relative to one another via interaction of the one of the rod and the fastener in the first aperture, the second aperture, the third aperture, the fourth aperture, the fifth aperture, the sixth aperture, and the seventh aperture.

2. The locking mechanism of claim 1 in combination with a component of the surgical frame, the component of the surgical frame comprising a base portion attached relative to the surgical frame, and including an aperture extending therethrough, the aperture of the base portion including an interior surface and being configured to receive portions of the first shaft portion and the second shaft portion therein, wherein expansion of the first shaft portion and the second shaft portion relative to one another impinges the first exterior surface of the first shaft portion and the second exterior surface of the second shaft portion against the interior surface of the aperture in the base portion to hold the arm portion in position relative to the base portion.

3. The combination of claim 2, wherein, when the handle portion is unactuated, the first shaft portion and the second shaft portion are unexpanded with respect to one another, and the first shaft portion and the second shaft portion are capable of linear and rotational movement in the aperture formed in the base portion.

4. The locking mechanism of claim 1 used as part of a shoulder hold-down for use in securing at least a shoulder of a patient in position relative to the surgical frame, the shoulder hold-down comprising the locking mechanism, a support shaft portion, a shoulder engaging portion, and a base portion, the support shaft portion including a first end, an opposite second end, and being configured to be received between the first contact surface and the second contact surface of the locking mechanism, the shoulder engaging portion being attached to the first end of the support shaft portion, and including a shoulder contacting structure configured to contact at least the shoulder of the patient, the base portion being attached relative to the surgical frame, and including an aperture extending therethrough, the aperture of the base portion including an interior surface and being configured to receive portions of the first shaft portion and the second shaft portion therein, wherein movement of the first contact surface of the first flange and the second contact surface of the second flange toward one another causes impingement of the first contact surface and the second contact surface on the support shaft to hold the support shaft in position relative to the arm portion, and wherein movement expansion of the first shaft portion and the second shaft portion relative to one another causes impingement of the first exterior surface of the first shaft portion and the second exterior surface of the second shaft portion against the interior surface of the aperture in the base portion to hold the arm portion in position relative to the base portion.

5. The shoulder hold-down of claim 4, wherein, when the handle portion is unactuated, the first contact surface of the first flange and the second flange are spaced apart from one another, and the support shaft is capable of linear and rotational movement between the first contact surface of the first flange and the second contact surface of the second flange.

6. The shoulder hold-down of claim 4, wherein, when the handle portion is unactuated, the first shaft portion and the second shaft portion are unexpanded with respect to one another, and the first shaft portion and the second shaft portion are capable of linear and rotational movement in the aperture formed in the base portion.

7. The shoulder hold-down of claim 4, wherein the shoulder engaging portion further comprises a pivot connection position between the shoulder contacting structure and the first end of the support shaft, the pivot connection facilitating pivotal movement of the shoulder engaging portion relative to the support shaft.

8. A locking mechanism for use with a surgical frame, the locking mechanism comprising:

an arm portion including a first shaft portion, a second shaft portion, and a first flange portion, the arm portion including a first end, an opposite second end, a mid-longitudinal axis extending through the first end and the second end, and a channel extending from at least adjacent the first end to at least adjacent the second end along the mid-longitudinal axis, portions of the second shaft portion being moveable into and out of the channel, the first shaft portion including a first exterior surface, the second shaft portion including a second exterior surface, the first shaft portion adjacent the first end of the arm portion including a first aperture on a first side of the channel, the first shaft portion adjacent the first end of the arm portion including a second aperture on a second side of the channel, and the second shaft portion adjacent the first end of the arm portion including a third aperture;

a handle portion having a clevis portion including a first lateral portion and a second lateral portion, the first lateral portion and the second lateral portion of the handle portion being spaced apart from one another, the first lateral portion of the handle portion including a fourth aperture and a first cam surface formed thereon, and the second lateral portion of the handle portion including a fifth aperture and a second cam surface formed thereon;

a bracket portion and a second flange portion, the bracket portion including at least a third lateral portion and a fourth lateral portion, the third lateral portion and the fourth lateral portion of the bracket portion being spaced apart from one another, the second flange portion being positioned between the third lateral portion and the fourth lateral portion of the bracket portion, the third lateral portion of the bracket portion including a sixth aperture, and the fourth lateral portion of the bracket portion including a seventh aperture; and one of a rod and a fastener extending through the first aperture, the second aperture, the third aperture, the fourth aperture, the fifth aperture, the sixth aperture, and the seventh aperture to attach the arm portion, the bracket portion, and the handle portion to one another;

wherein, when the locking mechanism is assembled, the portions of the second shaft portion are received in the channel of the first shaft portion, end portions of each of the first shaft portion and the second shaft portion adjacent the first end of the arm portion being received between the first lateral portion and the second lateral portion of the handle portion, and the first lateral portion and the second lateral portion of the handle portion being received between the third lateral portion and the fourth lateral portion of the bracket portion, and wherein the first cam surface and the second cam surface of the handle portion are contactable to at least one surface of the first flange portion, and movement of the handle portion from an unactuated position to an actuated position causes the first cam surface and the second cam surface to translate on the at least one surface, and simultaneously move the first contact surface of the first flange and the second contact surface of the second flange toward one another, and move the second shaft portion at least partially out of the channel in the first shaft portion to expand the first shaft portion and the second shaft portion relative to one another.

9. The locking mechanism of claim 8 in combination with a component of the surgical frame, the component of the surgical frame comprising a base portion attached relative to the surgical frame, and including an aperture extending therethrough, the aperture of the base portion including an interior surface and being configured to receive portions of the first shaft portion and the second shaft portion therein, wherein expansion of the first shaft portion and the second shaft portion relative to one another impinges the first exterior surface of the first shaft portion and the second exterior surface of the second shaft portion against the interior surface of the aperture in the base portion to hold the arm portion in position relative to the base portion.

10. The combination of claim 9, wherein, when the handle portion is unactuated, the first shaft portion and the second shaft portion are unexpanded with respect to one another, and the first shaft portion and the second shaft portion are capable of linear and rotational movement in the aperture formed in the base portion.

11. The locking mechanism of claim 8 used as part of a shoulder hold-down for use in securing at least a shoulder of a patient in position relative to the surgical frame, the shoulder hold-down comprising the locking mechanism, a support shaft portion, a shoulder engaging portion, and a base portion, the support shaft portion including a first end, an opposite second end, and being configured to be received between the first contact surface and the second contact surface of the locking mechanism, the shoulder engaging portion being attached to the first end of the support shaft portion, and including a shoulder contacting structure configured to contact at least the shoulder of the patient, the base portion being attached relative to the surgical frame, and including an aperture extending therethrough, the aperture of the base portion including an interior surface and being configured to receive portions of the first shaft portion and the second shaft portion therein, wherein movement of the first contact surface of the first flange and the second contact surface of the second flange toward one another causes impingement of the first contact surface and the second contact surface on the support shaft to hold the support shaft in position relative to the arm portion, and wherein movement expansion of the first shaft portion and the second shaft portion relative to one another causes impingement of the first exterior surface of the first shaft portion and the second exterior surface of the second shaft portion against the interior surface of the aperture in the base portion to hold the arm portion in position relative to the base portion.

12. The shoulder hold-down of claim 11, wherein, when the handle portion is unactuated, the first contact surface of the first flange and the second flange are spaced apart from one another, and the support shaft is capable of linear and rotational movement between the first contact surface of the first flange and the second contact surface of the second flange.

13. The shoulder hold-down of claim 11, wherein, when the handle portion is unactuated, the first shaft portion and the second shaft portion are unexpanded with respect to one another, and the first shaft portion and the second shaft portion are capable of linear and rotational movement in the aperture formed in the base portion.

14. The shoulder hold-down of claim 11, wherein the shoulder engaging portion further comprises a pivot connection position between the shoulder contacting structure and the first end of the support shaft, the pivot connection facilitating pivotal movement of the shoulder engaging portion relative to the support shaft.

15. A shoulder hold-down for use in securing at least a shoulder of a patient in position relative to a surgical frame, the shoulder hold-down comprising:

a support shaft portion including a first end, an opposite second end, and being configured to be received between the first contact surface and the second contact surface of the locking mechanism;

a shoulder engaging portion being attached to the first end of the support shaft portion, and including a shoulder contacting structure configured to contact at least the shoulder of the patient; and a locking mechanism including:

an arm portion including a first shaft portion, a second shaft portion, and a first flange portion, the arm portion including a first end, an opposite second end, a mid-longitudinal axis extending through the first end and the second end, and a channel extending from at least adjacent the first end to at least adjacent the second end along the mid-longitudinal axis, the channel receiving portions of the second shaft portion therein, the first shaft portion including a first exterior surface, the second shaft portion including a second exterior surface, the first shaft portion adjacent the first end of the arm portion including a first aperture on a first side of the channel, the first shaft portion adjacent the first end of the arm portion including a second aperture on a second side of the channel, and the second shaft portion adjacent the first end of the arm portion including a third aperture;

a handle portion having a clevis portion including a first lateral portion and a second lateral portion, the first lateral portion and the second lateral portion of the handle portion being spaced apart from one another, the first lateral portion of the handle portion including a fourth aperture and a first cam surface formed thereon, and the second lateral portion of the handle portion including a fifth aperture and a second cam surface formed thereon, end portions of each of the first shaft portion and the second shaft portion adjacent the first end of the arm portion being received between the first lateral portion and the second lateral portion of the clevis portion;

a bracket portion and a second flange portion, the bracket portion including at least a third lateral portion and a fourth lateral portion, the third lateral portion and the fourth lateral portion of the bracket portion being spaced apart from one another, the second flange portion being positioned between the third lateral portion and the fourth lateral portion of the bracket portion, the third lateral portion of the bracket portion including a sixth aperture, and the fourth lateral portion of the bracket portion including a seventh aperture, the first lateral portion and the second lateral portion of the handle portion being received between the third lateral portion and the fourth lateral portion of the bracket portion; and one of a rod and a fastener extending through the first aperture, the second aperture, the third aperture, the fourth aperture, the fifth aperture, the sixth aperture, and the seventh aperture to attach the arm portion, the bracket portion, and the handle portion to one another;

wherein the support shaft portion is received between the first contact surface of the first flange and the second contact surface of the second flange, and wherein the first cam surface and the second cam surface of the handle portion are contactable to at least one surface of the first flange portion, and movement of the handle portion from an unactuated position to an actuated position causes the first cam surface and the second cam surface to translate on the at least one surface, and move the first contact surface of the first flange and the second contact surface of the second flange toward one another to impinge on the support shaft and hold the support shaft in position, and move the second shaft portion at least partially out of the channel in the first shaft portion to expand the first shaft portion and the second shaft portion relative to one another via interaction of the one of the rod and the fastener in the first aperture, the second aperture, the third aperture, the fourth aperture, the fifth aperture, the sixth aperture, and the seventh aperture.

16. The shoulder hold-down of claim 15, further comprising a base portion attached relative to the surgical frame, and including an aperture extending therethrough, the aperture of the base portion including an interior surface and being configured to receive portions of the first shaft portion and the second shaft portion therein, wherein expansion of the first shaft portion and the second shaft portion relative to one another impinges the first exterior surface of the first shaft portion and the second exterior surface of the second shaft portion against the interior surface of the aperture in the base portion to hold the arm portion in position relative to the base portion.

17. The shoulder hold-down of claim 16, wherein, when the handle portion is unactuated, the first shaft portion and the second shaft portion are unexpanded with respect to one another, and the first shaft portion and the second shaft portion are capable of linear and rotational movement in the aperture formed in the base portion.

18. The shoulder hold-down of claim 17, wherein, when the handle portion is unactuated, the first contact surface of the first flange and the second flange are spaced apart from one another, and the support shaft is capable of linear and rotational movement between the first contact surface of the first flange and the second contact surface of the second flange.

19. The shoulder hold-down of claim 18, wherein the shoulder engaging portion further comprises a pivot connection position between the shoulder contacting structure and the first end of the support shaft, the pivot connection facilitating pivotal movement of the shoulder engaging portion relative to the support shaft.

20. The shoulder hold-down of claim 15, wherein movement of the first contact surface of the first flange and the second contact surface of the second flange, and movement of the second shaft portion at least partially out of the channel in the first shaft portion occurs simultaneously.

* * * * *